US010473442B1

(12) United States Patent
Roper et al.

(10) Patent No.: US 10,473,442 B1
(45) Date of Patent: Nov. 12, 2019

(54) MORTAR BOMB

(71) Applicant: BAE SYSTEMS plc, London (GB)

(72) Inventors: Mark Edward Roper, Monmouthshire (GB); Craig Ian Young, Monmouthshire (GB); Christopher Anthony Thomas, Monmouthshire (GB)

(73) Assignee: BAE SYSTEMS plc, London (GB)

( * ) Notice: Subject to any disclaimer, the term of this patent is extended or adjusted under 35 U.S.C. 154(b) by 0 days.

(21) Appl. No.: 16/469,989

(22) PCT Filed: Nov. 29, 2017

(86) PCT No.: PCT/GB2017/053598

§ 371 (c)(1),
(2) Date: Jun. 14, 2019

(87) PCT Pub. No.: WO2018/109436

PCT Pub. Date: Jun. 21, 2018

(30) Foreign Application Priority Data

Dec. 16, 2016 (GB) ..... 1621491.8
Jan. 18, 2017 (EP) ..... 17152022

(51) Int. Cl.

| | |
|---|---|
| ***F42B 30/00*** | (2006.01) |
| ***F42B 30/10*** | (2006.01) |
| *F42B 10/38* | (2006.01) |
| *F42B 10/02* | (2006.01) |

(52) U.S. Cl.
CPC ..... *F42B 30/10* (2013.01); *F42B 10/02* (2013.01); *F42B 10/38* (2013.01)

(58) Field of Classification Search
CPC ..... F42B 10/02; F42B 10/12; F42B 10/38; F42B 10/42; F42B 30/08; F42B 30/10
See application file for complete search history.

(56) References Cited

U.S. PATENT DOCUMENTS

| | | | | |
|---|---|---|---|---|
| 1,825,517 A * | 9/1931 | Gardner | F42B 30/08 102/478 |
| 2,315,145 A | 3/1943 | Wauters | |
| 3,023,704 A | 3/1952 | Dawson et al. | |
| 3,143,074 A * | 8/1964 | Jasse | F42B 14/02 102/525 |

(Continued)

FOREIGN PATENT DOCUMENTS

| | | |
|---|---|---|
| FR | 774170 A | 12/1934 |
| GB | 365003 A | 1/1932 |

(Continued)

OTHER PUBLICATIONS

International Search Report and Written Opinion for PCT Application No. PCT/GB2017/053598. dated Feb. 1, 2018. 11 pages.

(Continued)

*Primary Examiner* — Gabriel J. Klein
(74) *Attorney, Agent, or Firm* — Finch & Maloney PLLC

(57) ABSTRACT

According to an aspect of the invention, there is provided a mortar bomb, comprising: a main body; a nose; a tail extending from the main body, away from the nose; an obturating ring groove for accommodating, in use, an obturating ring, the ring groove being located in the main body; wherein a maximum diameter of the main body is upstream of the ring groove, toward the nose.

20 Claims, 6 Drawing Sheets

(56) References Cited

U.S. PATENT DOCUMENTS

Figure 1:
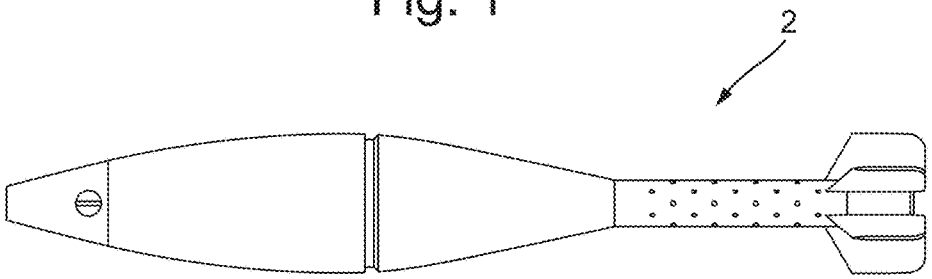

| | | | | | |
|---|---|---|---|---|---|
| 4,413,567 | A * | 11/1983 | Frostig | F42B 30/10 | 102/525 |
| 4,552,071 | A * | 11/1985 | Horais | F42B 14/02 | 102/524 |
| 4,748,912 | A * | 6/1988 | Garcia | F42B 30/10 | 102/372 |
| 6,401,622 | B1 * | 6/2002 | Brinkmann | F42B 14/02 | 102/524 |

FOREIGN PATENT DOCUMENTS

| | | | |
|---|---|---|---|
| GB | 538712 | A | 8/1941 |
| GB | 933114 | A | 8/1963 |
| GB | 2058303 | A | 4/1981 |
| WO | 2009095536 | A1 | 8/2009 |
| WO | 2018109436 | A1 | 6/2018 |

OTHER PUBLICATIONS

GB Search Report under Section 17(5) for GB Application No. 1621491.8 dated Apr. 12, 2017. 3 pages.
Extended European Search Report for EP Application No. 17152022.4, dated Jun. 13, 2017. 8 pages.
International Preliminary Report on Patentability for PCT Application No. PCT/GB2017/053598. dated Jun. 18, 2019. 6 pages.

* cited by examiner

MORTAR BOMB

The present invention relates to a mortar bomb.

When a mortar bomb is fired, people and objects in the vicinity of the firing location are subjected to blast overpressure effects. This can be detrimental or even damaging to the surrounding people or objects. It might be possible to at least partially shield one or more parts of the people or objects from the overpressure effects. For example shields, goggles or ear defenders might be used to protect people. However, this approach requires the use of additional high-specification equipment or procedures, which needs to be employed each time the mortar bomb is fired, which can add to operational cost and complexity. Higher overpressure effects might be disadvantageous even with such protection being employed.

It is therefore an example aim of example embodiments of the present invention to at least partially solve, avoid, or overcome one or more problems of the prior art, whether identified herein or elsewhere, or to at least provide a viable alternative to existing apparatus or methods.

According to an aspect of the invention, there is provided a mortar bomb, comprising: a main body; a nose; a tail extending from the main body, away from the nose; an obturating ring groove for accommodating, in use, an obturating ring, the obturating ring groove being located in the main body; wherein a maximum diameter of the main body is upstream of the obturating ring groove, toward the nose.

The maximum diameter of the main body may be located upstream of the obturating ring groove by a distance of substantially 0.3 to 0.4 times a calibre of the mortar bomb.

The maximum diameter of the main body may be located upstream of an edge of the obturating ring groove closest to the nose, by a distance of 0.3 to 0.4 times a calibre of the mortar bomb.

A difference in diameter between the maximum diameter of the main body, and a diameter at the ring groove, may be 0.01 to 0.015 times a calibre of the mortar bomb.

The diameter at the obturating ring groove may be the diameter at the greatest radial extent of the obturating ring groove.

Immediately downstream of the ring groove, toward the tail, a profile of the main body may initially extend substantially axially with respect to a longitudinal axis of the mortar bomb.

Downstream of the ring groove, immediately adjacent to the tail, a profile of the main body may be curved to meet and blend with a profile of the tail.

The profile of the tail immediately adjacent to the main body may extend substantially axially with respect to a longitudinal axis of the mortar bomb.

Downstream of the ring groove, a gradient of the main body profile, substantially in-between the ring groove and the tail, may be greater than a gradient of a substantially straight line theoretically extending between the ring groove and the tail.

Downstream of the ring groove, a gradient of the main body profile, substantially at a mid-point between the ring groove and the tail, is greater than a gradient of a substantially straight line theoretically extending between the ring groove and the tail.

According to another aspect of the invention, there is provided a mortar bomb main body, comprising: an obturating ring groove for accommodating, in use, an obturating ring; wherein a maximum diameter of the main body is upstream of the ring groove.

Figure 2:
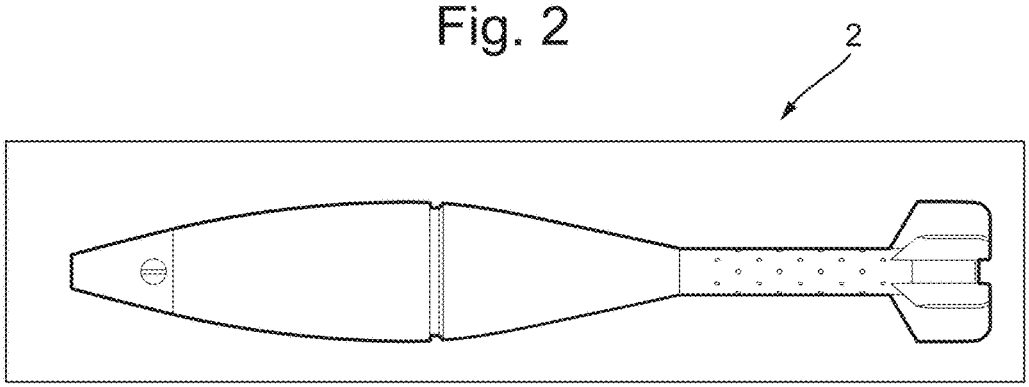
Figure 3:
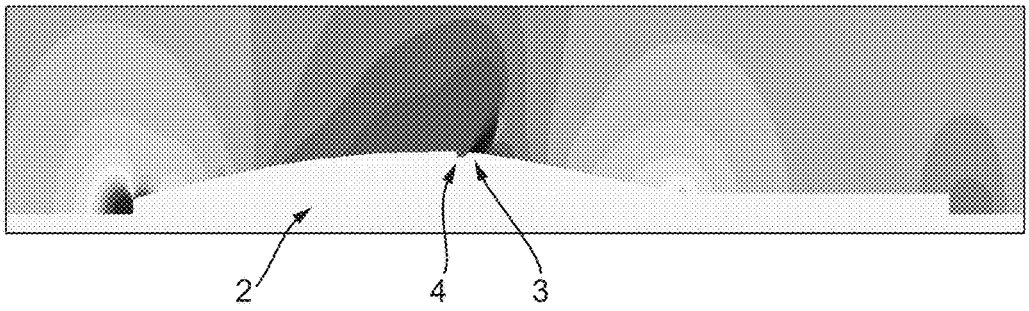
Figure 4:
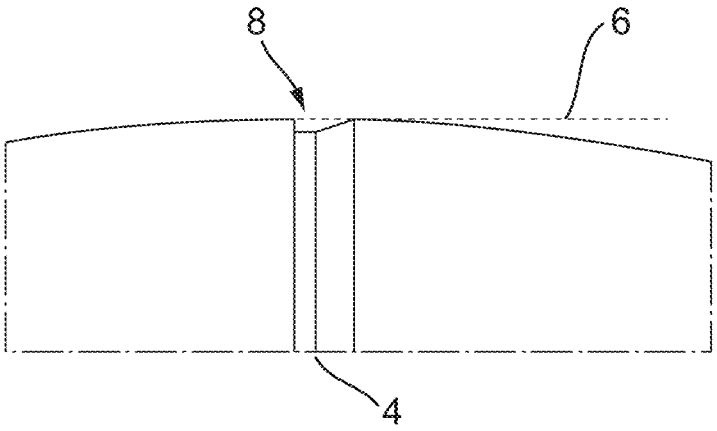
Figure 5:
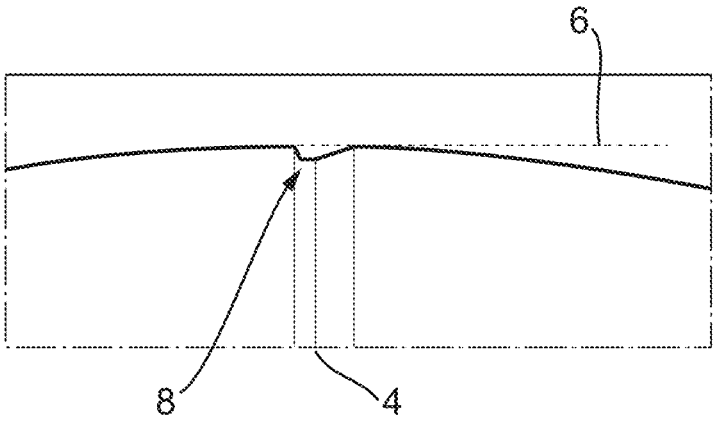
Figure 6:
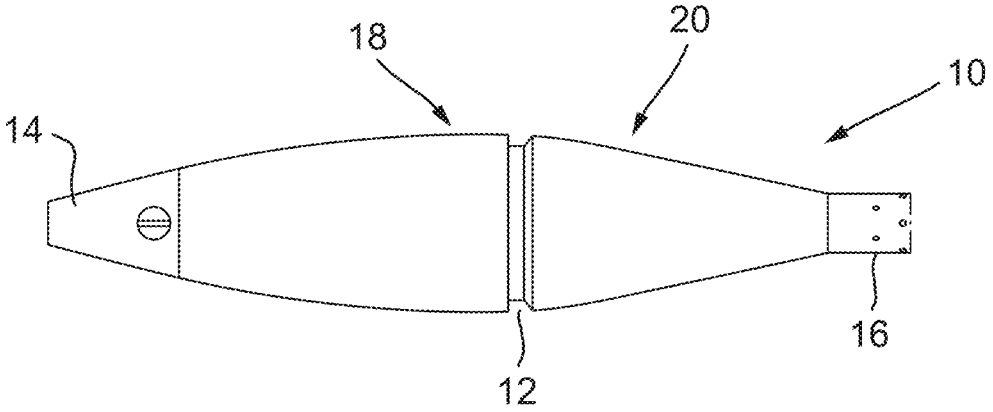
Figure 7:
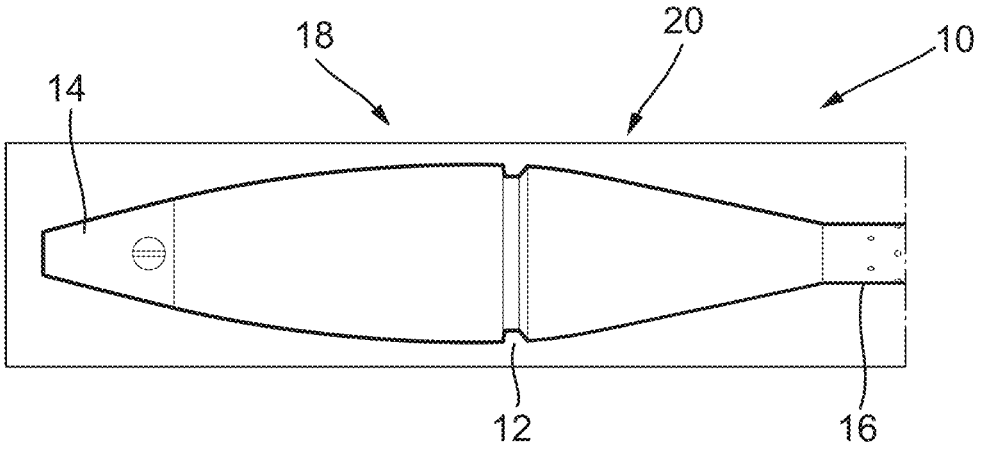
Figure 8:
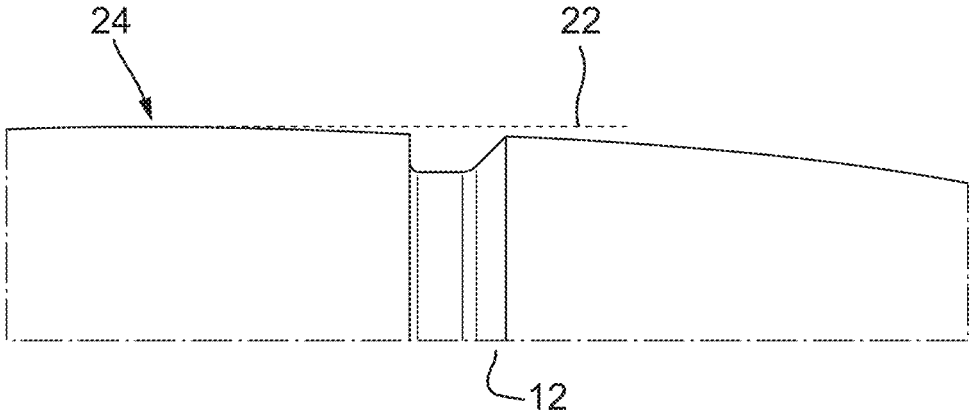
Figure 9:
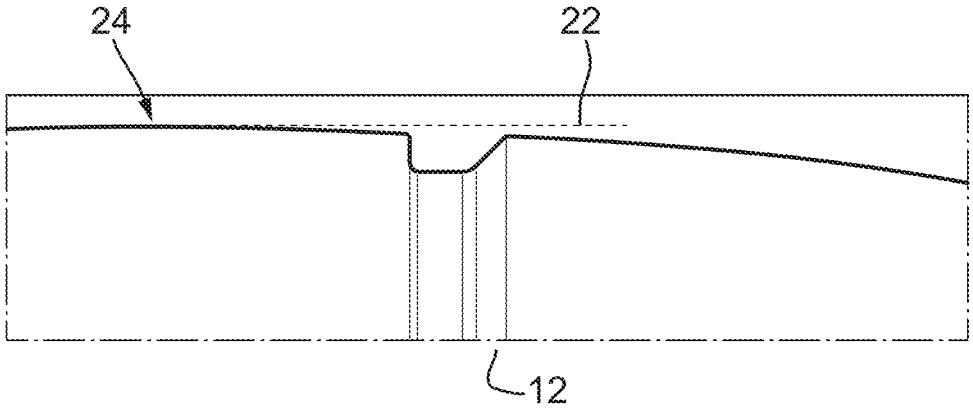
Figure 10:
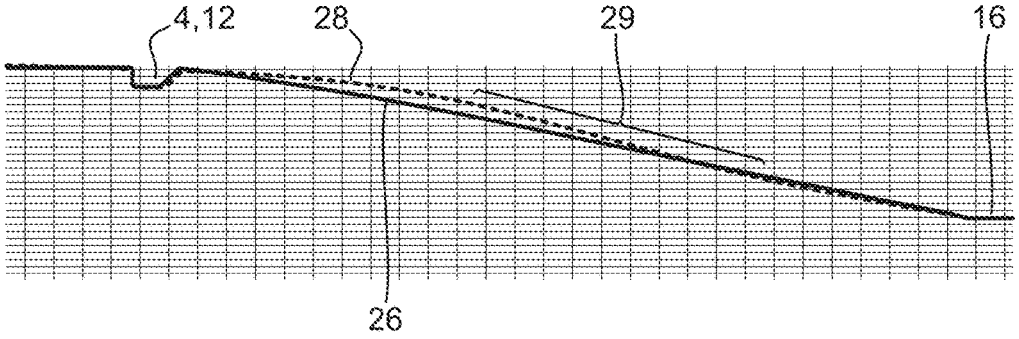
Figure 11:
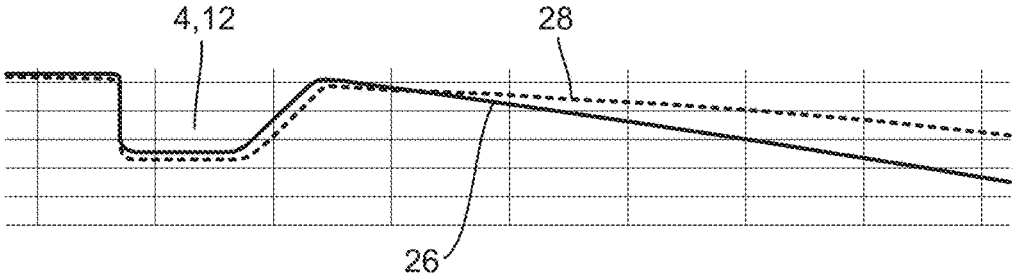
Figure 12:
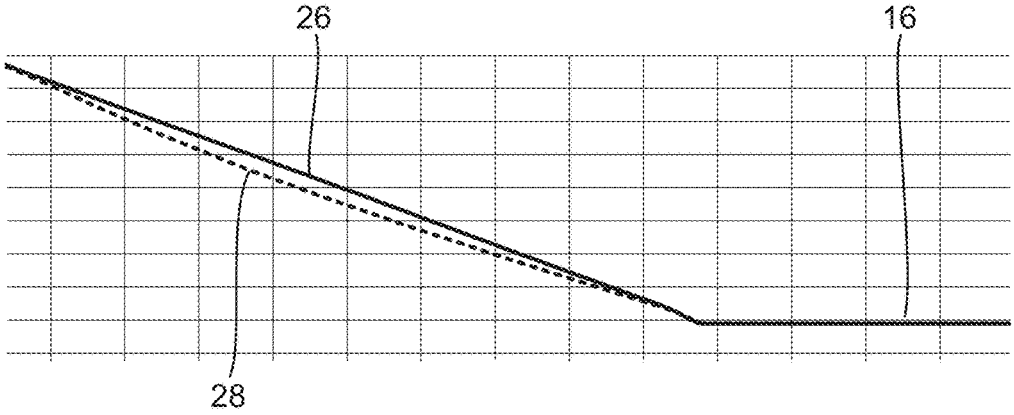
Figure 13:
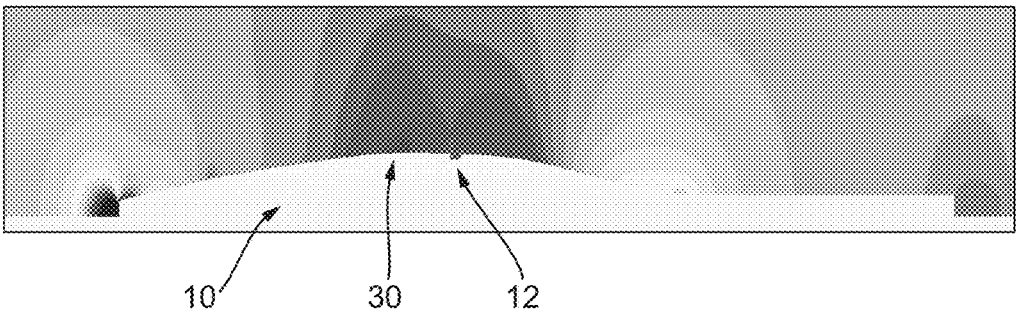
Figure 14:
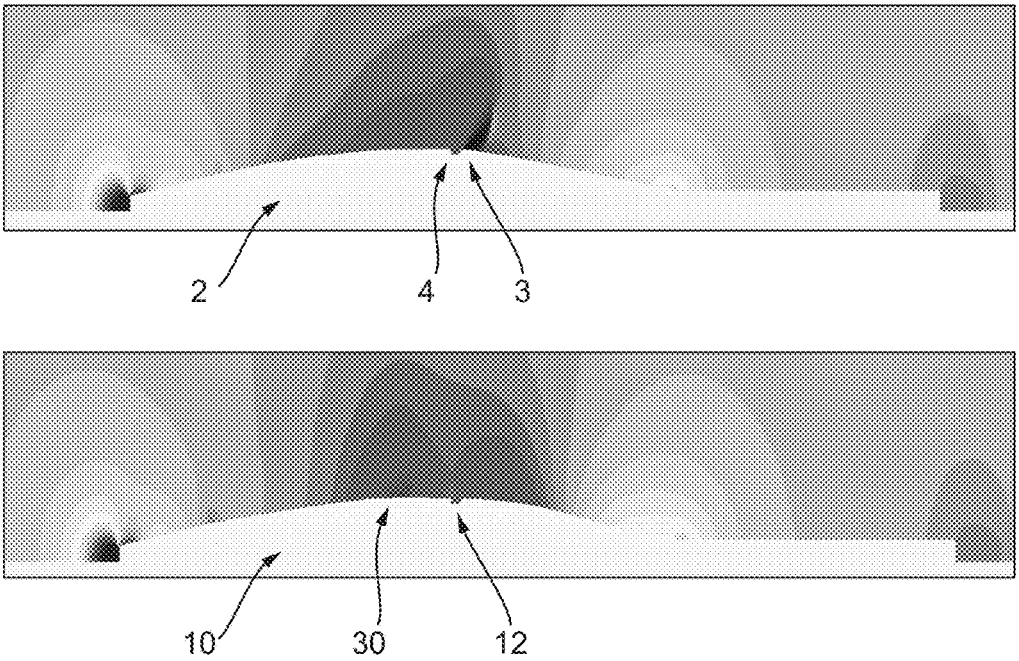

For a better understanding of the invention, and to show how embodiments of the same may be carried into effect, reference will now be made, by way of example, to the accompanying diagrammatic Figures in which:

FIG. 1 schematically depicts an existing mortar bomb;

FIG. 2 schematically depicts an outline of the modular of FIG. 1;

FIG. 3 schematically depicts an air pressure profile around an outline of the mortar bomb of FIGS. 1 and 2;

FIGS. 4 and 5 schematically depict properties of a maximum diameter of the mortar bomb of FIGS. 1 and 2 in standard and outline views, respectively;

FIGS. 6 and 7 schematically depict profiles of a main body of a mortar bomb according to an example embodiment, in standard and outline views, respectively;

FIGS. 8 and 9 schematically depict principles associated with a maximum diameter of the main body of the mortar bomb of FIGS. 6 and 7 in standard and outline views, respectively;

FIG. 10 schematically depicts a comparison between an existing main body profile downstream of an obturating ring groove of a mortar bomb, and an exemplary embodiment profile downstream of such an obturating ring groove;

FIG. 11 schematically depicts more detail of the comparison of FIG. 10, immediately adjacent to the ring groove of the mortar bomb;

FIG. 12 schematically depicts more detail of the comparison of FIG. 10, immediately adjacent to the tail of the mortar bomb;

FIG. 13 schematically depicts an air pressure profile about the main body of the mortar bomb according to an example embodiment; and FIG. 14 schematically depicts a side-by-side comparison of the pressure profiles of FIG. 3 and FIG. 13.

As discussed above, overpressure effects at the firing location of a mortar can have a negative effect on the people or objects in the vicinity of the firing location. It is desirable to avoid having to use additional equipment or procedures during the firing in order to limit or avoid the effects of the overpressure, or to at least reduce the need or level of such equipment or procedures. In general, reduction in overpressure makes it easier to operate the firing of the mortar bomb, or to work in the environment of such firing.

A relatively straightforward way of reducing the overpressure effects is to simply reduce the overpressure, by way of reducing the charge that is required to fire the mortar bomb. However, and of course, without other modifications, reducing the charge would reduce the firing range of the mortar bomb. So, if this reduction in charge for firing the mortar bomb is to be realised in practice, a given or typical mortar bomb fired from the location will, ideally, need to somehow maintain its firing range, even through the firing charge is reduced.

According to example embodiments, it has been realised that a mortar bomb can be re-designed or re-shaped to have reduced drag, thereby allowing the (i.e. a typical) mortar bomb to travel further (i.e. have a longer range) when used with the same charge, or to have the same range as a typical or standard (that is, not re-designed as described herein) mortar bomb when fired with a reduced charge. Overall, then, overpressure effects are reduced, for given firing range, when compared with an existing mortar bomb fired over that same range.

An existing mortar bomb, and associated problems, will be described initially. An improved mortar bomb, according to example embodiments, will then be described.

FIG. 1 shows an existing mortar bomb (2). This same mortar bomb is shown in FIG. 2, with an outline view for clarity, so that the profile of the mortar bomb (2) can be more readily seen.

FIG. 3 shows a pressure profile about the mortar bomb (2) during flight. Increased regions of air pressure are shown in darker shading. It can be seen that at the high speeds typical due in the trajectory of a mortar bomb, significant air pressure shock (3) is located at or immediately adjacent to an obturating ring groove (4) of the mortar bomb (2). The obturating ring groove (4) is used to accommodate an obturating ring during firing of the mortar bomb. This shock (3), and its location at the obturating ring groove (4), significantly adds to the drag on the mortar bomb (2).

FIGS. 4 and 5 schematically depict a region of the existing mortar bomb, around the obturating ring groove (4), in standard and outline views respectively. These Figures show that the main body of the mortar bomb has a diameter (6) which is at a maximum (8) at the location of the ring groove (4). The significance of this feature, relative to example embodiments, will be discussed in further detail below.

FIGS. 6 and 7 schematically depict a main-body of a mortar bomb (10) according to an example embodiment. As with all, typical mortar bombs, the mortar bomb (10) of FIG. 6 has an obturating ring groove (12) for accommodating, in use, an obturating ring. Upstream of that ring groove (12), at one end of the mortar bomb (10) is a nose (14) of the mortar bomb (10). At an opposite end of the main body, remote from the nose (14), is a tail (16) of the mortar bomb (10). Although not shown in the Figures, the tail (16) typically defines, is, or is attached to, one or more fins for stabilising the mortar bomb (10) during flight.

The nose (14) of the mortar bomb (10) might be, or comprise (e.g. house) a fuze. The nose (14) might be attached or attachable to, or part of, the main body of the mortar bomb (10). That is, the nose (14) and main body may not be formed integrally with one another.

In accordance with example embodiments, regions upstream (18) of the ring groove (12), toward the nose (14), and downstream (20) of the ring groove (12), toward the tail (16) have been re-designed or re-shaped to reduce drag.

FIGS. 8 and 9 schematically depict principles associated with a maximum diameter of a mortar bomb according to an example embodiment, in standard and outline views respectively. As discussed previously with respect to existing mortar bombs, the mortar bomb according to example embodiments will, of course, have a diameter (22) which will reach a maximum (24). What is different, however, with the mortar bomb according to an example embodiment, is that the maximum diameter (24) of the curved surface does not occur (i.e. is not located) at the obturating ring groove (12), but is instead located upstream of the obturating ring groove (12), towards the nose of the mortar bomb.

The difference in profile of the main body with respect to the location of the maximum diameter (24) of the mortar bomb is subtle but extremely important. It has been found that this subtle but fundamental change in the profile of the mortar bomb has a significant effect on the air pressure profile in the vicinity of the mortar bomb during its trajectory. In particular, it has been found that the air pressure shock is moved upstream of the ring groove (12), significantly reducing air pressure drag. While the shock is indeed moved upstream, the fact that the shock is allowed to form on a continuous body geometry, rather than the sudden change associated with the groove (12), is what causes the reduction in drag to be so pronounced.

It can be seen from the Figures that the maximum diameter is not at, or does not form, an annular band or ring, but is instead a maximum diameter of the generally curved outer surface of the main body. This is a maximum diameter of the generally curved outer surface of the main body, and not a separate entity that might in some way attach to or surround the main body. For example, the maximum diameter of the generally curved outer surface of the main body is not, and is not the same as, a guiding belt or bore rider that might surround the main body when in a launch tube or similar. It is worth noting that the mortar bomb (which includes the main body) of the present invention is free of (that is, not provided with) a bore rider or guide belt, especially when in flight. This is because such a bore rider would make the mortar bomb far less aerodynamic and, in the context of the present invention, would remove the subtle but important aerodynamic benefits of the particular location of the maximum diameter of the main body.

It would appear that moving the maximum diameter upstream of the ring groove does, in general, result in a reduction in drag (at least to a certain extent). It has, however, been found that this effect is even more pronounced and even optimised when the location of the maximum diameter of the main body of the mortar bomb is located upstream of the obturating ring groove by distance of substantially 0.3 to 0.4×a (typical) calibre of the mortar bomb, and more particularly when the maximum diameter is 0.3 to 0.4×a (typical) calibre of the mortar bomb upstream of an edge of the obturating ring groove that is closest to the nose of the mortar bomb.

Of course, in existing mortar bombs, the maximum diameter of the main body is at the same location as the obturating ring groove. In contrast, in example embodiments, the diameter at or of the obturating ring groove will be different to the maximum diameter of the main body of the mortar bomb. The exact differences between these obturating ring groove diameters and maximum diameters will vary depending on the overall profile of the mortar bomb, to achieve a reduction in drag. However, it has been found that drag reduction might be optimised when a difference in diameter between the maximum diameter of the main body, and a diameter at the obturating ring groove, is 0.01 to 0.015×a (typical) calibre of the mortar bomb. This is found to be particularly the case when this comparison is implemented when the diameter at the obturating ring groove is a diameter at the greatest radial extent of the ring groove (i.e. the diameter of the mortar bomb at the peak of the groove, as opposed to the trough).

Re-designing or re-shaping the profile of the mortar bomb upstream of the ring groove as discussed above has been found to lead to a reduction in drag. However, the rear section of the mortar bomb according to example embodiments, downstream of the ring groove and towards the tail of the mortar bomb, can also be re-designed or re-shaped to reduce or further reduce drag.

FIG. 10 shows a comparison between profiles, downstream of the ring grooves (4, 12) of an existing profile (26), and a profile according to an example embodiment (28). In general terms, FIG. 10 shows that the downstream or rear section of example embodiments has been altered to have a generally shallower gradient extending away and down from the ring groove (12), toward the tail (16). This is to the extent that a gradient of the main body profile, substantially in-between the ring groove (12) and the tail (16) (i.e. substantially at and/or around a mid-point (29) between the ring groove (12) and the tail (16)) is greater than a gradient of a substantially straight line theoretically extending between the ring groove and the most upstream section of the tail. The rear profile of an existing mortar bomb, downstream of the ring groove (4) typically extends in such a linear manner FIG. 11 shows an exploded view of FIG. 10 that focuses on the vicinity of the ring groove (4, 12). Compared with the more linearly extending profile of the existing mortar bomb (26), it can be seen that the profile of the main body of example embodiments (28), downstream of the ring groove (12) and immediately adjacent to the ring groove (12), extends substantially axially with respect to a longitudinal axis of the mortar bomb. This same Figure also shows how the existing profile gradient (26) is more linear, and has a far steeper gradient, immediately extending away from the ring groove (4), than the shallower gradient of the profile (28) of example embodiments that extends from the ring groove (12). This example embodiment profile (28) feature, again, reduces drag.

FIG. 12 shows an exploded view of the comparison of FIG. 10, but now in the vicinity of where the main body of the mortar bomb meets the tail (16) of the mortar bomb. It can be seen that the profile (26) of the existing mortar bomb extends substantially linearly towards and into angled adjoinment with the tail (16). The tail (16), as is typical, extends substantially axially in respect to the longitudinal axis of the mortar bomb. In stark contrast with the existing profile (26), it can be seen that a gradient of the main body profile (28) of example embodiments is curved to meet and blend with the profile of the tail. This example embodiment profile (28) feature, again, reduces drag.

Each of the changes in profile discussed in FIGS. 10 to 12 have been found to contribute to reduce drag by encouraging boundary layer adhesion along the full length of the main body downstream of the ring groove. In combination, then, each of these changes leads to an even more significant reduction in drag. A key aspect is that the gradient of the bomb profile before and after the obturating ring groove is as similar as possible, to reduce drag. This is made much easier by not having the obturating ring groove at the maximum diameter.

FIG. 13 shows the pressure profile surrounding the mortar bomb (10) of example embodiments, during a flight trajectory of the mortar bomb (10). It can be seen that the highest pressure region, or shock (30), is no longer located at the location of the obturating ring groove (12), but has moved upstream of the obturating ring (12) towards the nose of the mortar bomb (10). In particular, the shock (30) will still be located at or near the largest diameter of the main body, but in accordance with example embodiments, this largest diameter is away from, not at, the location of the ring groove (12). In other words, there is distance between the groove (12), which include an edge of that groove (12), and the largest diameter. Overall, drag is significantly reduced. The changes to the profile downstream of the ring groove (12) work synergistically with this change in location of maximum diameter, to reduce drag even further.

FIG. 14 is included simply to easily show the comparison of the pressure profiles with the existing mortar bomb (2) and the re-shaped or re-designed mortar bomb (10) according to example embodiments. Again, it can be seen that drag is significantly reduced with the mortar bomb (10) of example embodiments, as discussed above. The shock (3, 30), in particular, is significantly reduced in accordance with example embodiments (30).

It has been found that the most significant factor in the reduction of drag is the change of the location of the largest diameter of the main body of the mortar bomb, as discussed above. Changes to the shape of the mortar bomb downstream of the ring groove are perhaps less significant, but nevertheless also reduce drag. The changes downstream of the obturating ring groove might be used to reduce drag in isolation (i.e. separately to or independent of changes upstream of the groove), but it has been found in simulations that the changes upstream and downstream of the ring groove work in a synergistic manner to achieve a more significant reduction in overall drag of the mortar bomb. That is, while the changes can reduce drag in isolation, the combined effects are greater than simply the addition of individual contributions.

It has been found that the above principles are consistently advantageous for mortar bombs of different calibres, for example 51 mm, 74 mm, 75 mm, 81 mm, and 120 mm, and in particular those in the range of 74-81 mm. The above principles also appear to extend to sub-calibre mortar bombs, where the mortar bomb has a main body diameter, or main diameter in general, which is inferior (less than) an internal diameter of the barrel or tube from which the mortar bomb is, or is to be, fired.

Overall, it is perhaps counter-intuitive to completely redesign the profile of a mortar bomb in order to reduce its drag, in order to reduce the effects of overpressure on people or objects around a firing location of such a mortar bomb. Similarly, it is perhaps counter-intuitive to completely redesign the profile of a mortar bomb in order to reduce its drag, to make it easier to operate the firing of the mortar bomb, or to make it easier to work in the environment of such firing. In contrast, a more typical approach might be to simply increase or maintain existing safety equipment or procedures around that firing location, for example high specification goggles, ear defenders, or shielding. From another perspective, an alternative solution would be to reduce the firing, sacrificing range.

Of course, the invention has further benefits, in that if a given charge for firing a mortar is not reduced, the mortar described above will have an increased range. Also, it will be appreciated that the mortar as described above can be used with existing firing apparatus. That is, the firing apparatus does not have to be re-designed or otherwise modified to accommodate the firing of the new mortar bomb discussed above, while still enjoying the described benefits.

The invention relates generally to a mortar bomb. However, the invention relates perhaps most specifically to a main body of such a mortar bomb. So, the main body as described above could be used with, and attached to, existing noses or even tails.

For the avoidance of any doubt, an "obturating ring" as used herein is typically a ring of relatively soft material designed to obturate under pressure to form a seal. Obturating rings are often found in artillery and other ballistics applications. The "ring groove" described herein is typically continuous around a circumference of the mortar bomb, but in some examples could be substantially continuous, or discontinuous (e.g. comprise one or more interruptions), such that the "obturating ring groove" is a groove that generally extends around the circumference of the mortar bomb in a ring-like manner. Changes in the diameter of the main body, or changes in location of the maximum diameter of the main body, may be such that an existing obturating ring (suitable for a non-modified/re-designed main body/mortar bomb) may still be suitably used. However, a different obturating ring can be used (e.g. one with a different inner and/or outer diameter) if changes in the diameter of the main body, or changes in location of the maximum diameter of the main body, are such that the existing obturating ring does not function as intended.

Although a few preferred embodiments have been shown and described, it will be appreciated by those skilled in the art that various changes and modifications might be made without departing from the scope of the invention, as defined in the appended claims.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A mortar bomb, comprising:

a main body;

a nose attached to the main body;

a tail extending from the main body, away from the nose; and an obturating ring groove for accommodating, in use, an obturating ring, the obturating ring groove being located in the main body, wherein an outer surface of the main body is curved along a profile from the nose to the ring groove, and wherein a maximum diameter of the outer surface of the main body is located upstream of the ring groove, toward the nose, and not at the ring groove, the maximum diameter of the outer surface of the main body being different from a diameter of the main body at an outer edge of the ring groove closest to the nose.

2. The mortar bomb of claim 1, wherein the maximum diameter of the main body is located upstream of the ring groove by a distance of 0.3 to 0.4 times a calibre of the mortar bomb.

3. The mortar bomb of claim 1, wherein the maximum diameter of the main body is located upstream of an edge of the ring groove closest to the nose, by a distance of 0.3 to 0.4 times a calibre of the mortar bomb.

4. The mortar bomb of claim 1, wherein a difference in diameter between the maximum diameter of the main body, and a diameter at the ring groove, is 0.01 to 0.015 times a calibre of the mortar bomb.

5. The mortar bomb of claim 4, wherein the diameter at the ring groove is the diameter at the greatest radial extent of the ring groove.

6. The mortar bomb of claim 1, wherein immediately downstream of the ring groove, toward the tail, a profile of the main body initially extends substantially axially with respect to a longitudinal axis of the mortar bomb.

7. The mortar bomb of claim 1, wherein downstream of the ring groove, immediately adjacent to the tail, a profile of the main body is curved to meet and blend with a profile of the tail.

8. The mortar bomb of claim 7, wherein the profile of the tail immediately adjacent to the main body extends substantially axially with respect to a longitudinal axis of the mortar bomb.

9. The mortar bomb of claim 1, wherein downstream of the ring groove, a gradient of the main body profile, substantially in-between the ring groove and the tail, is greater than a gradient of a substantially straight line theoretically extending between the ring groove and the tail.

10. The mortar bomb of claim 1, wherein downstream of the ring groove, a gradient of the main body profile, substantially at a mid-point between the ring groove and the tail, is greater than a gradient of a substantially straight line theoretically extending between the ring groove and the tail.

11. A mortar bomb main body, comprising:

an obturating ring groove for accommodating, in use, an obturating ring; and an outer surface curved along a profile from a nose attached to the mortar bomb main body to the ring groove, wherein a maximum diameter of the outer surface of the mortar bomb main body is located upstream of the ring groove, toward the nose, and not at the ring groove, the maximum diameter of the outer surface of the mortar bomb main body being different from a diameter of the mortar bomb main body at an outer edge of the ring groove closest to the nose.

12. The mortar bomb main body of claim 11, wherein the maximum diameter of the mortar bomb main body is located upstream of the ring groove by a distance of 0.3 to 0.4 times a calibre of the mortar bomb main body.

13. The mortar bomb main body of claim 11, wherein the maximum diameter of the mortar bomb main body is located upstream of an edge of the ring groove, by a distance of 0.3 to 0.4 times a calibre of the mortar bomb main body.

14. The mortar bomb main body of claim 11, wherein a difference in diameter between the maximum diameter of the mortar bomb main body, and a diameter at the ring groove, is 0.01 to 0.015 times a calibre of the mortar bomb main body.

15. The mortar bomb main body of claim 14, wherein the diameter at the ring groove is the diameter at the greatest radial extent of the ring groove.

16. The mortar bomb main body of claim 11, wherein downstream of the ring groove, toward a tail, a profile of the mortar bomb main body initially extends substantially axially with respect to a longitudinal axis of the mortar bomb main body.

17. The mortar bomb main body of claim 11, wherein downstream of the ring groove, adjacent to a tail, a profile of the mortar bomb main body is curved to meet and blend with a profile of the tail.

18. The mortar bomb main body of claim 17, wherein the profile of the tail adjacent to the mortar bomb main body extends substantially axially with respect to a longitudinal axis of the mortar bomb main body.

19. The mortar bomb main body of claim 11, wherein downstream of the ring groove, a gradient of the mortar bomb main body profile, in-between the ring groove and a tail, is greater than a gradient of a substantially straight line theoretically extending between the ring groove and the tail.

20. The mortar bomb main body of claim 11, wherein downstream of the ring groove, a gradient of the mortar bomb main body profile, substantially at a mid-point between the ring groove and the tail, is greater than a gradient of a substantially straight line theoretically extending between the ring groove and the tail.

* * * * *